US011323827B2

(12) United States Patent
Boretzki et al.

(10) Patent No.: US 11,323,827 B2
(45) Date of Patent: May 3, 2022

(54) SELF-FITTING OF HEARING DEVICE WITH USER SUPPORT

(71) Applicant: SONOVA AG, Staefa (CH)

(72) Inventors: Michael Boretzki, Ruti (CH); Erich Crameri, Zürich (CH); Nicola Hildebrand, Uster (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 17/127,113

(22) Filed: Dec. 18, 2020

(65) Prior Publication Data

US 2021/0195347 A1 Jun. 24, 2021

(30) Foreign Application Priority Data

Dec. 23, 2019 (EP) ..... 19219384

(51) Int. Cl.
*H04R 25/00* (2006.01)

(52) U.S. Cl.
CPC ..... *H04R 25/558* (2013.01); *H04R 25/30* (2013.01); *H04R 25/554* (2013.01); *H04R 2225/41* (2013.01)

(58) Field of Classification Search
CPC .. H04R 2225/41; H04R 25/30; H04R 25/558; H04R 25/554
USPC ..... 381/314
See application file for complete search history.

(56) References Cited

U.S. PATENT DOCUMENTS

| | | | |
|---|---|---|---|
| 6,035,050 | A | 3/2000 | Weinfurtner et al. |
| 2008/0226105 | A1 | 9/2008 | Barthel |
| 2011/0051963 | A1 | 3/2011 | Barthel |
| 2014/0369510 | A1 | 12/2014 | Barthel |

FOREIGN PATENT DOCUMENTS

| | | | |
|---|---|---|---|
| EP | 1858292 | 9/2006 | |
| WO | WO-2012010218 A1 * | 1/2012 | ..... H04R 25/50 |

OTHER PUBLICATIONS

Extended European Search Report received in EP Application No. 19219384.5 dated Jun. 26, 2020.

* cited by examiner

*Primary Examiner* — Phylesha Dabney
(74) *Attorney, Agent, or Firm* — ALG Intellectual Property, LLC

(57) ABSTRACT

A method for adjusting a hearing device includes: receiving an input sound signal; identifying a listening situation; selecting at least one hearing program from a plurality of hearing programs in dependence of the identified listening situation; processing the input sound signal using the at least one selected hearing program to generate a processed sound signal and providing the processed sound signal to a user of the hearing device; receiving an adjustment command for the one or more processing parameters; determining a change rate at which the listening situation changes; when the change rate is above a predefined threshold, applying the one or more adjusted processing parameters to a possible set of hearing programs from the plurality of hearing programs; and when the change rate is below the predefined threshold, applying the one or more adjusted processing parameters to the at least one selected hearing program.

14 Claims, 1 Drawing Sheet

SELF-FITTING OF HEARING DEVICE WITH USER SUPPORT

RELATED APPLICATIONS

The present application claims priority to EP Patent Application No. 19219384.5, filed Dec. 23, 2019, the contents of which are hereby incorporated by reference in their entirety.

BACKGROUND INFORMATION

Hearing devices are generally small and complex devices. Hearing devices can include a processor, microphone, speaker, memory, housing, and other electronical and mechanical components. Some example hearing devices are Behind-The-Ear (BTE), Receiver-In-Canal (RIC), In-The-Ear (ITE), Completely-In-Canal (CIC), and Invisible-In-The-Canal (IIC) devices. A user can prefer one of these hearing devices compared to another device based on hearing loss, aesthetic preferences, lifestyle needs, and budget.

Modern hearing devices usually have different hearing programs, which may be activated in specific listening situations, such as listening to music, being inside car, etc. Some hearing devices are able to switch between hearing programs automatically. These hearing devices are adapted for identifying a listening situation and then choosing the appropriate hearing program for it. It may be that several programs are active and that the sound output of these programs is mixed before being provided to the user.

Such an automatic program mixing system may have a rather long time constant (such as 20 sec), which may mean that the hearing device takes at least 20 seconds to get into a stable processing mode when the listening situation has changed. That in turn may mean that the user may have to wait for the system to get into this stable processing mode before he can take any action in fine tuning. If he would tune earlier, the result would not be beneficial.

Furthermore, when listening situations change fast (for example every 5 seconds), the sound processing parameterization in a hearing device with a slower time constant for a hearing program selecting and steering may always be behind the actual sound situation. As a result, a user trying to fine-tune the parametrization may act on inappropriate settings of the hearing device.

BRIEF DESCRIPTION OF THE DRAWINGS

Below, embodiments of the present invention are described in more detail with reference to the attached drawings.

The reference symbols used in the drawings, and their meanings, are listed in summary form in the list of reference symbols. In principle, identical parts are provided with the same reference symbols in the figures.

DETAILED DESCRIPTION

Figure 1:
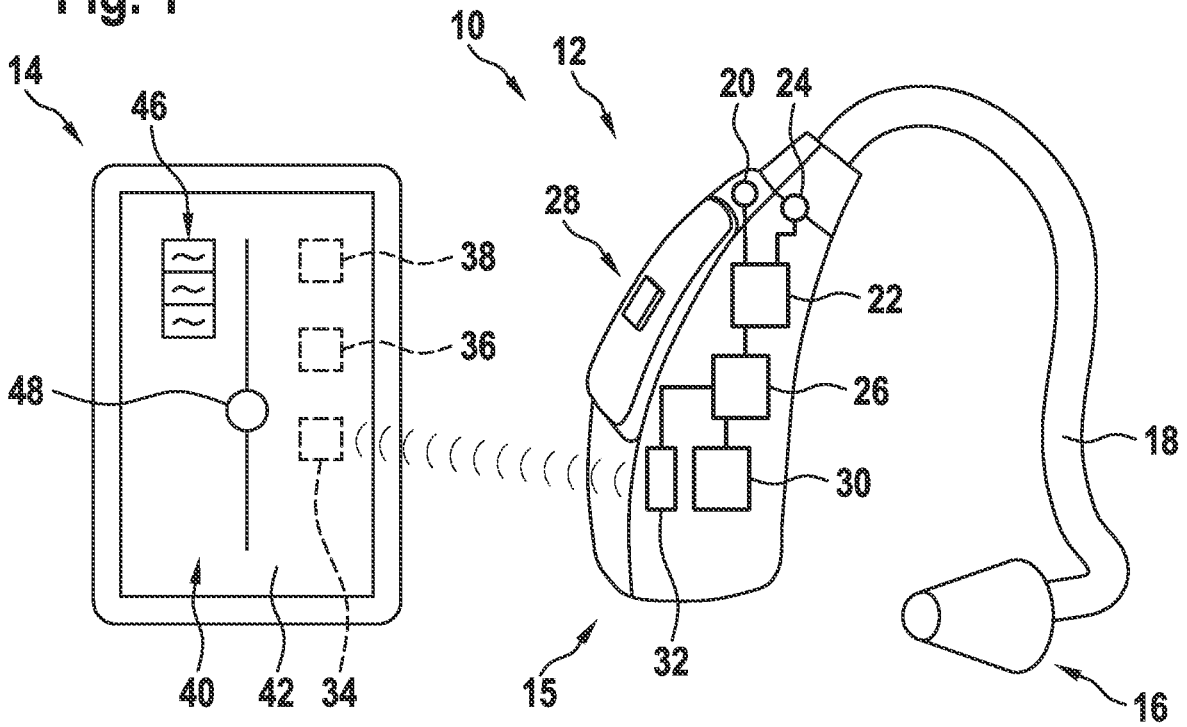
FIG. 1 schematically shows a hearing system according to an embodiment.

Described herein are a method, a computer program and a computer-readable medium for adjusting a hearing device, which may be worn by a user. Furthermore, the embodiments described herein relate to a hearing system.

An aspect described herein is to simplify the fine tuning of a hearing device.

This aspect is achieved by the subject-matter of the independent claims. Further exemplary embodiments are evident from the dependent claims and the following description.

A first aspect relates to a method for adjusting a hearing device. The hearing device may be worn by a user, for example behind the ear or in the ear. The hearing device may be a hearing aid for compensating a hearing loss of a user. Here and in the following, when to a hearing device is referred, also a pair of hearing devices, i.e. a hearing device for each ear of the user, may be meant.

According to an embodiment, the method comprises: receiving an input sound signal and identifying a listening situation based on the input sound signal by means of sound classification. The input sound signal may be generated by a microphone of the hearing device and/or may be received in the hearing device via a data communication connection, for example from a mobile device, such as a smartphone. The listening situation may be determined by a classifier, i.e. a program module, adapted for processing the sound signal in view of properties of the content of the sound signal. For example, listening situations may be identified based on at least one of a sound class, a sound level, a signal-to-noise ratio, a mean reverberation time, a frequency distribution, a direction of arrival information, and a selected mode of operation. In general, the listening situation may comprise one or more values (such as probabilities), which associated the sound signal with specific situations, in which the user is in. Examples for such situations are listening to music, listening to speech, being in a car, being in a restaurant, etc.

According to an embodiment, the method comprises: selecting at least one from a plurality of hearing programs in dependence of the identified listening situation, wherein one or more processing parameters are associated with the hearing programs; and processing the input sound signal using the at least one selected hearing program to generate a processed sound signal and providing the processed sound signal to a user of the hearing device, wherein preset processing parameters for the at least one selected hearing program are applied to the at least one selected hearing program.

A hearing program may be a program module of the hearing device adapted for processing the input sound signal in a specific way. For example, a hearing program may suppress noise, may attenuate sound from a specific direction, may compress and/or shift frequencies, etc. The one or more processing parameters may be control parameters, which influence the processing of the respective hearing program.

A hearing program may be selected by switching it on and/or by applying the preset processing parameters to it, such that it outputs a processed sound signal. A hearing program may be deselected by switching it off and/or by applying processing parameters, which result in no signal output of the hearing program. It may be that based on the identified listening situation, preset one or more processing parameters for different hearing programs are mixed with each other and then applied to the different hearing programs.

When more than one hearing program is active, the sound signals generated by the hearing programs may be mixed with each other, for example based on the identified listening situation.

According to an embodiment, the method further comprises: receiving an adjustment command for the one or more processing parameters, the adjustment command being generated by the user with a user interface and determining one or more adjusted processing parameters from the adjustment command. The adjustment command may be generated with a knob of the hearing device and/or with a (for example virtual) control element of a mobile device, which is in data communication with the hearing device. For example, the adjustment command may relate to volume, clearness, treble, bass, etc. There may be a mapping table and/or mapping function, which may be performed in the hearing device and/or in the mobile device, which maps the adjustment command into adjusted processing parameters. For example, such a mapping may map a change in the volume into a change of specific processing parameters of a specific hearing program.

According to an embodiment, the method further comprises: determining a change rate at which the listening situation changes. Such a range rate may be a number, for example indicating the average time during which a specific identified listening situation is present and/or before it changes into another specific identified listening situation.

The application of the adjusted processing parameters to the hearing programs takes place in dependency of the change rate.

When the change rate is above a predefined threshold, the one or more adjusted processing parameters are applied to a possible set of hearing programs from the plurality of hearing programs, the possible set of hearing programs comprising the at least one selected hearing program and at least one hearing program, which is selectable after a change of the listening situation. For example, the adjusted processing parameters may be applied to all hearing programs. It also may be that depending on the listening situations, which have been identified during a past time window, the possible hearing programs are determined, which may be activated in a future time window and solely to those hearing programs the one or more adjusted processing parameters are applied.

In such a way, in fluctuating listening situations, the user adjustment is applied to all possible hearing programs that may be identified and/or activated. However, in such fluctuating listening situations, the changes are not made permanent. This opens the possibility that a user can tune his or her hearing device even during such situation.

On the other hand, when the change rate is below the predefined threshold, the one or more adjusted processing parameters are applied solely to the at least one selected hearing program and the preset processing parameters for the at least one selected hearing program are updated to the adjusted processing parameters. In a stable listening situation, the one or more adjusted processing parameters may be applied solely to the one or more hearing programs, which are currently selected and this change is then made permanent. In this way, the adjustments made by a user during a stable listening situation are reproduced, when the listening situation occurs again.

According to an embodiment, the one or more adjusted processing parameters are discarded and the one or more preset processing parameters are applied to the possible set of hearing programs, when the change rate is above the predefined threshold and after that falls below the predefined threshold. As already mentioned, when the listening situation becomes stable, which may be indicated by the change rate falling below the threshold, the tuning made by the user in fluctuating listening situations may be discarded. In this case, the preset processing parameters may be used for processing the sound signal.

According to an embodiment, the one or more preset processing parameters are stored in the hearing device, for example in a memory of the hearing device. The one or more preset processing parameters may be stored for different listening situations in the hearing device. Whenever another listening situation is identified, different, the one or more preset processing parameters stored for this listening situation may be applied to the selected hearing programs. In such a way, also the adjusted processing parameters, which are made permanent by replacing preset processing parameters with them, will be applied again to the hearing programs, when the same listening situation is identified again.

According to an embodiment, the hearing device is connected via a data communication connection with a mobile device of the user. The mobile device may be a smartphone or table computer carried by the user. Via this data communication connection, sound streams may be exchanged between the hearing device and the mobile device, for example during a telephone call. The user interface for generating the adjustment command may be provided by the mobile device. For example, the user interface may provide control elements, such a sliders and knobs, which may be actuated by the user to generate the adjustment command.

The user interface may be a graphical user interface. However, it also may be that an acoustical user interface in combination with mechanical control elements is provided by the hearing device itself.

According to an embodiment, the listening situation is provided to the user via the user interface. It may be that the listening situation and in particular a name of the listening situation is displayed and/or read out to the user. The user then can decide, whether he wants to adjust the tuning of the hearing device in this listening situation.

According to an embodiment, the change rate of the listening situation is provided to the user via the user interface. It may be that the change rate is displayed and/or read out to the user. The user then may decide, whether it is beneficial to tune the hearing device.

According to an embodiment, indicators that the change rate is above the predefined threshold and that the change rate is below the predefined threshold are provided to the user via the user interface. Such indicators may be displayed and/or read out to the user. The user therefore is aware, whether his or her changes are permanent or not.

According to an embodiment, an interest command for a specific listening situation is received, the adjustment command being generated by the user with the user interface. The interest commands may indicate that the user wishes to tune this specific listening situation. The interest command also may be generated with a control element of the user interface of the mobile device.

When the selected listening situation equals the specific listening situation, the one or more adjusted processing parameters may be applied to the at least one selected hearing program. When the selected listening situation is different from the specific listening situation, the one or more preset processing parameters may be applied to the at least one selected hearing program. In such a way, also in fluctuating listening situations, solely the processing parameters for one specific listening situation may be tuned by the user.

According to an embodiment, when a change in a listening situation is identified, the hearing device waits for a time constant, until the at least one selected hearing program is activated and the sound signal is processed with the at least one selected hearing program. The time constant may depend on the identification time, which is needed by the hearing device and/or the mobile device for identifying the listening situation and additionally for a present time offset, in which a stabilization of the listening situation is assumed. The time offset may be substantially larger than the identification time.

According to an embodiment, when the change rate of the listening situation raises above the predefined threshold, the time constant is set to a smaller value. For example, the above-mentioned time offset may be set to smaller values or even to 0. In such a way, from a point of view of the user, the hearing device reacts much faster in fluctuation listening situations and the tuning of the hearing device in such situations is applied much faster.

When the change rate of the listening situation falls below the predefined threshold, the time constant may be reset to a preset value.

Further aspects relate to a computer program for adjusting a hearing device, which, when being executed by at least one processor, is adapted to carry out the steps of the method as described in the above and in the following as well as to a computer-readable medium, in which such a computer program is stored.

For example, the computer program may be executed in a processor of the hearing device. The computer-readable medium may be a memory of this hearing device. The computer program also may be executed by a processor of the mobile device and the computer-readable medium may be a memory of the mobile device. It also may be that steps of the method are performed by the hearing device and other steps of the method are performed by the mobile device.

In general, a computer-readable medium may be a floppy disk, a hard disk, an USB (Universal Serial Bus) storage device, a RAM (Random Access Memory), a ROM (Read Only Memory), an EPROM (Erasable Programmable Read Only Memory) or a FLASH memory. A computer-readable medium may also be a data communication network, e.g. the Internet, which allows downloading a program code. The computer-readable medium may be a non-transitory or transitory medium.

Further aspects relate to the hearing device as described above and below and/or to a hearing system comprising such a hearing device. The hearing system optionally may comprise a mobile device as described above and below. The hearing device and/or the hearing system may be adapted for performing the method as described above and below.

It has to be understood that features of the method as described in the above and in the following may be features of the computer program, the computer-readable medium, the hearing device and the hearing system as described in the above and in the following, and vice versa.

These and other aspects will be apparent from and elucidated with reference to the embodiments described hereinafter.

FIG. 1 schematically shows a hearing system 10 with a hearing device 12 in the form of a behind-the-ear device and a mobile device 14. It has to be noted that the hearing device 12 is a specific embodiment and that the method described herein also may be performed by other types of hearing devices, such as in-the-ear devices.

The hearing device 12 comprises a part 15 behind the ear and a part 16 to be put in the ear channel of a user. The part 15 and the part 16 are connected by a tube 18. In the part 15, a microphone 20, a sound processor 22 and a sound output device 24, such as a loudspeaker, are provided. The microphone 20 may acquire environmental sound of the user and may generate a sound signal, the sound processor 22 may amplify the sound signal and the sound output device 24 may generate sound that is guided through the tube 18 and the in-the-ear part 16 into the ear channel of the user.

The hearing device 12 may comprise a processor 26, which is adapted for adjusting parameters of the sound processor 22, such that an output volume of the sound signal is adjusted based on an input volume. These parameters may be determined by a computer program run in the processor 26. For example, with a knob 28 of the hearing device 12, a user may select a modifier (such as bass, treble, noise suppression, dynamic volume, etc.) and levels and/or values of these modifiers may be selected, from this modifier, an adjustment command may be created and processed as described above and below. In particular, processing parameters may be determined based on the adjustment command and based on this, for example, the frequency dependent gain and the dynamic volume of the sound processor 22 may be changed. All these functions may be implemented as computer programs stored in a memory 30 of the hearing device 12, which computer programs may be executed by the processor 22.

The hearing device 12 may comprise a sender/receiver 32 for (for example wireless) data communication with a sender/receiver 34 of the mobile device 14, which may be a smartphone or tablet computer. It is also possible that the above-mentioned modifiers and their levels and/or values are adjusted with the mobile device 14 and/or that the adjustment command is generated with the mobile device 14. This may be performed with a computer program run in a processor 36 of the mobile device 14 and stored in a memory 38 of the mobile device 14. The computer program may provide a graphical user interface 40 on a display 42 of the mobile device 14.

For example, for adjusting the modifier, such as volume, the graphical user interface 40 may comprise a control element 44, such as a slider. When the user adjusts the slider, an adjustment command may be generated, which will change the sound processing of the hearing device 12 as described above and below. Alternatively or additionally, the user may adjust the modifier with the hearing device 12 itself, for example via the knob 28.

The user interface 40 also may comprise an indicator element 46, which, for example, displays a currently determined listening situation.

Figure 2:
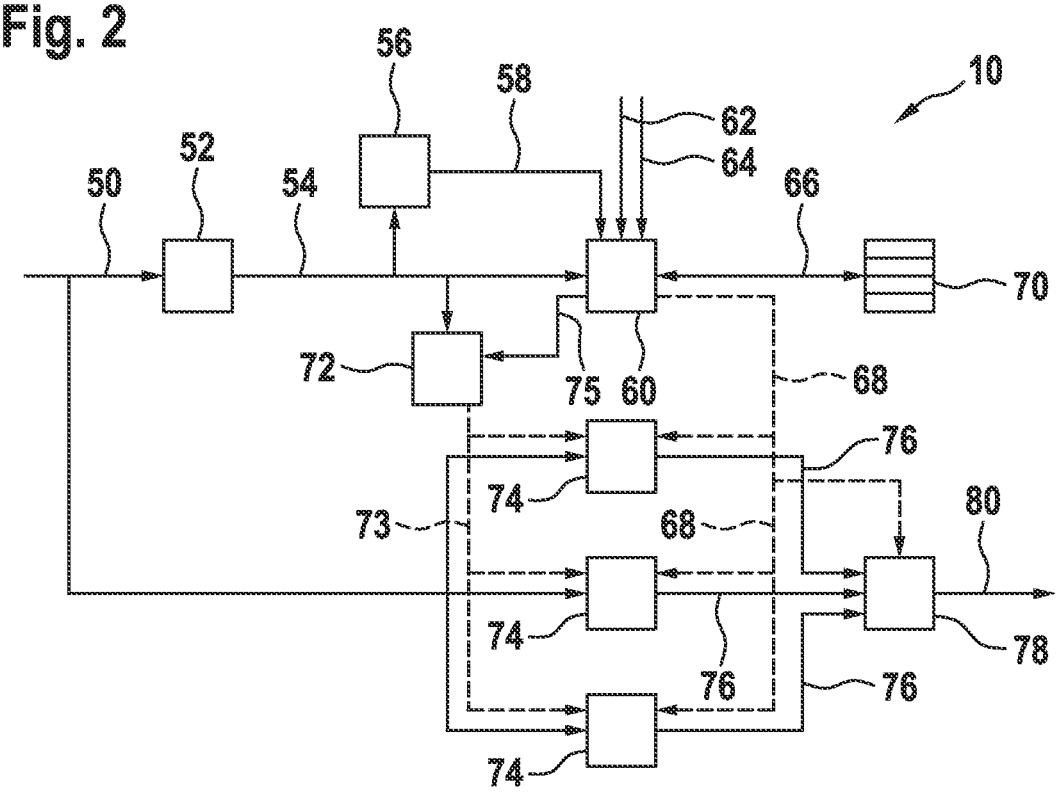
FIG. 2 schematically shows a functional diagram of a hearing system according to an embodiment, which is also used for illustrating a method according to an embodiment.

FIG. 2 shows a functional diagram of the hearing system 10. The boxes of FIG. 2 all may be program modules of a computer program run in the hearing device 12 and optionally the mobile device 14.

The input sound signal 50, which may be generated by the microphone 20 and/or may be received from the mobile device 14, is classified by the sound classifier 52 into a listening situation 54. The listening situation 54 may be a code, which encodes the actual sound situation the user is in based on the sound signal 50. The sound classifier 52 may identify the listening situation 54 based on a sound class, a sound level, a signal-to-noise ratio, a mean reverberation time, a frequency distribution, a direction of arrival information and/or a selected mode of operation.

The identified listening situation 54 may be provided to the user via the user interface 40. For example, the identified listening situation 54 and in particular its name may be displayed by the indicator element 46.

The listening situation 54 then is provided to a rate determiner 56, which determines a change rate 58 for the listening situation 54. For example, the change rate may be a number, which indicates the average time, in which the listening situation 54 does not change. Also the change rate 58 of the listening situation 54 may be provided to the user via the user interface 40. In particular, the value of the change rate 58 may be displayed by the indicator element 46. It also may be that it is output by the user interface 40, whether the change rate 58 is above the predefined threshold or that the change rate 58 is below the predefined threshold. For example, this can be done with a corresponding symbol displayed by the indicator element 46.

The listening situation 54 and the change rate 58 are supplied to a parameter selector 60, which also receives adjustment commands 62 and optionally interest commands 64, which may be generated by the user interface 40.

The parameter selector 60 receives preset processing parameters 66 and based on its inputs 54, 58, 62, 64 generates adjusted processing parameters 68, as will be described below. In particular, the preset processing parameters 66 are stored in a parameter storage 70, wherein for each listening situation 54, preset processing parameters 66 are stored. It also may be that the parameter selector 60 overwrites some of the preset processing parameters 66 for a listening situation 54 with adjusted processing parameters 68 it has determined. The parameter storage 70 may be implemented in the memory 70.

The listening situation 54 is also supplied to a program selector 72, which based on the identified listening situation 54, selects at least one from a plurality of the hearing programs 74 in dependence of the identified listening situation 54. To this end, a mapping table and/or mapping function may be present in the program selector 72, which table and/or function is used for selecting the one or more hearing programs 74 associated with the listening situation 54. The program selector 72 generates a selection signal 73, which is provided to the hearing programs 74.

When a hearing program 74 is selected, it is activated and uses the processing parameters 68 applied to it for generating a processed sound signal 76. When a hearing program 74 is deselected, it is deactivated and/or outputs a sound signal equal to 0.

It may be that the selection of the one or more hearing programs 74 is delayed with a time constant 75, when the identified listening situation 54 changes. When a change in the listening situation 54 is identified, the hearing device 12 waits for a time constant 75, until the at least one selected hearing program 74 is activated and the input sound signal 50 is processed with the at least one selected hearing program 74. This time constant may be set and/or changed by the parameter selector 60 in dependence of the presence of an adjustment command 62 and the change rate 58. When the change rate 58 of the listening situation 54 raises above a predefined threshold, the time constant 75 may be set to a smaller value. When the change rate 58 of the listening situation falls below the predefined threshold, the time constant is reset to a preset value. This may help the user in tuning the hearing device 12 with the adjustment command 62, since the hearing device 12 may react faster to the changes applied by the user.

The operation of the parameter selector 60 and in particular the generator of the adjusted processing parameters 68 depends on the presence of an adjustment command 62 and/or an interest command 64.

In the case, when no adjustment command 62 is present, the parameter selector 60 selects the preset processing parameters 68 for the hearing programs 74, which are stored in the parameter storage 70. Thus, the preset processing parameters 66 for the selected hearing programs 74 are applied to these hearing programs and the other hearing programs are deactivated by the program selector 72. This may be seen as the usual operation mode of the hearing device 12.

When an adjustment command 62 for the one or more processing parameters 66 is received, the parameter selector 60 determines one or more adjusted processing parameters 68 based on this adjustment command 62. The adjustment command 62 may be generated by the user, who for example has actuated the control element 44 of the user interface 40.

The parameter selector 60 may comprise one or more adjustment functions, which map the adjustment command 62 to changes in the processing parameters 66. For example, the adjustment command 62 may encode a change in volume or more general in a modifier as mentioned above. The one or more adjustment functions may receive this value and a set of processing parameters 66 and may output adjusted processing parameters 68.

The application of the adjusted processing parameters 68 to the hearing programs 74 depends on the change rate 58 of the listening situation 54.

When the change rate 58 is above a predefined threshold, the one or more adjusted processing parameters 68 are applied to a possible set of hearing programs 74 from the plurality of hearing programs 74. The predefined threshold may be the same as the one used for changing the time constant 75. The possible set of hearing programs 74 may comprise the at least one selected hearing program 74 and at least one hearing program, which is selectable after a change of the listening situation 54. It also may be that the possible set of hearing programs 74 comprises all the hearing programs 74 of the hearing device 12.

The application of the adjusted processing parameters 68 is just temporary in this case. When the change rate 58 is above the predefined threshold and after that falls below the predefined threshold, the one or more adjusted processing parameters 68 are discarded and the one or more preset processing parameters 66 are applied to the possible set of hearing programs 74 by the parameter selector 60.

On the other hand, when the change rate 58 is below the predefined threshold, the one or more adjusted processing parameters 68 are solely applied to the at least one selected hearing program 74. In this case, the preset processing parameters 68 for the at least one selected hearing program 74 in the parameter storage 70 are updated to the adjusted processing parameters 68. This may be done additionally with respect to the identified listening situation 54. The processing parameters 68 in the parameter storage 70 may be stored with respect to the selected hearing program 74 and the identified listening situation 54.

When an interest command 64 for a specific listening situation is received in the parameter selector 60, the parameter selector 60 may react in a third way. When the selected listening situation 54 equals the specific listening situation, the one or more adjusted processing parameters 68 are applied to the at least one selected hearing program 74. When the selected listening situation 54 is different from the specific listening situation, the one or more preset processing parameters 66 are applied to the at least one selected hearing program 74. In this way, the tuning of the user may solely affect the hearing device 12, when the specific listening situation is identified. This may help the user in tuning the hearing device 12 in this situation.

The specific listening situation may be determined by the user via the user interface 40. For example, the user may tip on the indicator 46, when the desired listening situation is displayed by the indicator 46. A corresponding interest command 64 is then generated and sent to the hearing device 12, for example.

The hearing programs 74, when they are selected and activated, process the input sound signal 76, for example, by reducing noise, changing frequencies, attenuating sound from a specific direction, etc. This processing is performed based on the adjusted processing parameters 68, which have been applied to them.

The processed sound signals 76 output by the hearing programs 74 are supplied to a mixer 78, which mixes the processed sound signals 76 into an output sound signal 80. The mixing may be performed based on the adjusted processing parameters 68, which also may encode a mixing factor for each processed sound signal 76.

In the end, the processed sound signals 76 may be output to the user, for example via the sound output device 24.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art and practicing the claimed invention, from a study of the drawings, the disclosure, and the appended claims. In the claims, the word "comprising" does not exclude other elements or steps, and the indefinite article "a" or "an" does not exclude a plurality. A single processor or controller or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

LIST OF REFERENCE SYMBOLS

10 hearing system
12 hearing device
14 mobile device
15 part behind the ear
16 part in the ear
18 tube
20 microphone
22 sound processor
24 sound output device
26 processor
28 knob
30 memory
32 sender/receiver
34 sender/receiver
36 processor
38 memory
40 graphical user interface
42 display
44 control element, slider
46 indicator element
50 sound signal
52 sound classifier
54 listening situation
56 rate determiner
58 change rate
60 parameter selector
62 adjustment command
64 interest command
66 preset processing parameters
68 adjusted processing parameters
70 parameter storage
72 program selector
73 selection signal
74 hearing program
75 time constant
76 processed sound signal
78 mixer
80 output sound signal

What is claimed is:

1. A method for adjusting a hearing device, the method comprising:

receiving an input sound signal;

identifying a listening situation based on the input sound signal by means of sound classification;

selecting at least one hearing program from a plurality of hearing programs in dependence of the identified listening situation, wherein one or more processing parameters are associated with the hearing programs;

processing the input sound signal using the at least one selected hearing program to generate a processed sound signal and providing the processed sound signal to a user of the hearing device, wherein preset processing parameters for the at least one selected hearing program are applied to the at least one selected hearing program;

receiving an adjustment command for the one or more processing parameters, the adjustment command being generated by the user with a user interface and determining one or more adjusted processing parameters from the adjustment command;

determining a change rate at which the listening situation changes;

when the change rate is above a predefined threshold, applying the one or more adjusted processing parameters to a possible set of hearing programs from the plurality of hearing programs, the possible set of hearing programs comprising the at least one selected hearing program and at least one hearing program, which is selectable after a change of the listening situation;

when the change rate is below the predefined threshold, applying the one or more adjusted processing parameters to the at least one selected hearing program and updating the preset processing parameters for the at least one selected hearing program to the adjusted processing parameters.

2. The method of claim 1, wherein, when the change rate is above the predefined threshold and after that falls below the predefined threshold, the one or more adjusted processing parameters are discarded and the one or more preset processing parameters are applied to the possible set of hearing programs.

3. The method of claim 1, wherein the one or more preset processing parameters are stored in the hearing device; and/or wherein one or more preset processing parameters for different listening situations are stored in the hearing device.

4. The method of claim 1, wherein the hearing device is connected via a data communication connection with a mobile device of the user;

wherein the user interface for generating the adjustment command is provided by the mobile device.

5. The method of claim 1, wherein the identified listening situation is provided to the user via the user interface.

6. The method of claim 1, wherein the change rate of the listening situation is provided to the user via the user interface.

7. The method of claim 1, wherein an indicator is provided by the user interface, that the change rate is above the predefined threshold and that the change rate is below the predefined threshold.

8. The method of claim 1, wherein an interest command for a specific listening situation is received, the adjustment command being generated by the user with the user interface;

wherein, when the selected listening situation equals the specific listening situation, applying the one or more adjusted processing parameters to the at least one selected hearing program;

wherein, when the selected listening situation is different from the specific listening situation, applying the one or more preset processing parameters to the at least one selected hearing program.

9. The method of claim 1, wherein, when a change in a listening situation is identified, the hearing device waits for a time constant, until the at least one selected hearing program is activated and the input sound signal is processed with the at least one selected hearing program.

10. The method of claim 9, wherein, when the change rate of the listening situation raises above the predefined threshold, the time constant is set to a smaller value;

wherein, when the change rate of the listening situation falls below the predefined threshold, the time constant is reset to a preset value.

11. The method of claim 1, wherein the listening situation is identified based on at least one of sound class, a sound level, a signal-to-noise ratio, a mean reverberation time, a frequency distribution, a direction of arrival information, or a selected mode of operation.

12. The method of claim 1, wherein the hearing device is a hearing aid adapted for compensating a hearing loss of a user.

13. A non-transitory computer-readable medium storing a computer program for adjusting a hearing device, which, when being executed by a processor, is adapted to carry out the method of claim 1.

14. A hearing system comprising a hearing device, wherein the hearing system is adapted for performing the method of claim 1.

* * * * *